US010400609B2

(12) United States Patent
Hudson et al.

(10) Patent No.: US 10,400,609 B2
(45) Date of Patent: Sep. 3, 2019

(54) AIRFOIL COOLING CIRCUITS

(71) Applicant: United Technologies Corporation, Farmington, CT (US)

(72) Inventors: Eric A. Hudson, Harwinton, CT (US); Tracy A. Propheter-Hinckley, Manchester, CT (US); San Quach, Southington, CT (US); Matthew A. Devore, Rocky Hill, CT (US)

(73) Assignee: United Technologies Corporation, Farmington, CT (US)

( * ) Notice: Subject to any disclaimer, the term of this patent is extended or adjusted under 35 U.S.C. 154(b) by 0 days.

(21) Appl. No.: 15/866,134

(22) Filed: Jan. 9, 2018

(65) Prior Publication Data

US 2018/0128115 A1 May 10, 2018

Related U.S. Application Data

(62) Division of application No. 13/529,143, filed on Jun. 21, 2012, now Pat. No. 9,879,546.

(51) Int. Cl.

| | |
|---|---|
| ***B22C 9/10*** | (2006.01) |
| ***B22C 9/24*** | (2006.01) |
| ***F01D 5/18*** | (2006.01) |

(52) U.S. Cl.

CPC ..... *F01D 5/187* (2013.01); *B22C 9/10* (2013.01); *B22C 9/108* (2013.01); *B22C 9/24* (2013.01);

(Continued)

(58) Field of Classification Search

CPC ..... B22C 9/10; B22C 9/108; B22C 9/24

(Continued)

(56) References Cited

U.S. PATENT DOCUMENTS

| | | | |
|---|---|---|---|
| 5,779,437 | A | 7/1998 | Abdel-Messah et al. |
| 6,379,118 | B2 | 4/2002 | Lutum et al. |

(Continued)

FOREIGN PATENT DOCUMENTS

| | | |
|---|---|---|
| EP | 1790823 A2 | 5/2007 |
| GB | 2358226 A | 7/2001 |

OTHER PUBLICATIONS

Extended European Search Report for EP Application No. 13822892.9, dated Jul. 15, 2014, 7 Pages.

(Continued)

*Primary Examiner* — Kevin P Kerns

(74) *Attorney, Agent, or Firm* — Kinney & Lange, P.A.

(57) ABSTRACT

An airfoil includes leading and trailing edges; first and second sides extending from the leading edge to the trailing edge, each side having an exterior surface; a core passage located between the first and second sides and the leading and trailing edges; and a wall structure located between the core passage and the exterior surface of the first side. The wall structure includes a plurality of cooling fluid inlets communicating with the core passage for receiving cooling fluid from the core passage, a plurality of cooling fluid outlets on the exterior surface of the first side for expelling cooling fluid and forming a cooling film along the exterior surface of the first side, and a plurality of cooling passages communicating with the plurality of cooling fluid inlets and the plurality of cooling fluid outlets. At least a portion of one cooling passage extends between adjacent cooling fluid outlets.

4 Claims, 11 Drawing Sheets

(52) U.S. Cl.
CPC ..... *F01D 5/186* (2013.01); *F05D 2230/211* (2013.01); *F05D 2260/204* (2013.01); *F05D 2260/2212* (2013.01)

(58) Field of Classification Search
USPC ..... 164/369, 370
See application file for complete search history.

(56) References Cited

U.S. PATENT DOCUMENTS

| | | | | |
|---|---|---|---|---|
| 6,499,938 | B1 | 12/2002 | Pesetsky | |
| 6,929,054 | B2 | 8/2005 | Beals et al. | |
| 7,172,012 | B1 * | 2/2007 | Memmen | B22C 7/02 164/369 |
| 7,270,170 | B2 | 9/2007 | Beals et al. | |
| 7,273,351 | B2 | 9/2007 | Kopmels | |
| 7,364,405 | B2 | 4/2008 | Cunha et al. | |
| 7,438,118 | B2 | 10/2008 | Santeler | |
| 7,731,481 | B2 | 6/2010 | Cunha et al. | |
| 7,744,347 | B2 | 6/2010 | Cunha et al. | |
| 8,109,725 | B2 | 2/2012 | Abdel-Messeh et al. | |
| 8,157,527 | B2 | 4/2012 | Piggush et al. | |
| 8,231,330 | B1 | 7/2012 | Liang | |
| 9,879,546 | B2 * | 1/2018 | Hudson et al. | F01D 5/186 |
| 2003/0108423 | A1 | 6/2003 | Morgan et al. | |
| 2007/0044933 | A1 * | 3/2007 | Santeler | B22C 7/02 164/44 |
| 2007/0116569 | A1 | 5/2007 | Cunha et al. | |
| 2008/0031739 | A1 | 2/2008 | Devore et al. | |
| 2010/0014102 | A1 | 1/2010 | Blair | |
| 2010/0068067 | A1 | 3/2010 | Liang | |
| 2010/0129217 | A1 * | 5/2010 | Cherolis et al. | B22C 7/02 416/91 |
| 2011/0171023 | A1 | 7/2011 | Lee et al. | |
| 2011/0236178 | A1 | 9/2011 | Devore et al. | |

OTHER PUBLICATIONS

International Search Report and Written Opinion for PCT Application No. PCT/US2013/037302, dated Feb. 7, 2014, 12 Pages.
Communication Pursuant to Article 94(3) EPC from E.P. Application No. 13822892.9, dated Jun. 19, 2018, 4 Pages.

* cited by examiner

AIRFOIL COOLING CIRCUITS

CROSS-REFERENCE TO RELATED APPLICATION(S)

This application is a divisional of U.S. application Ser. No. 13/529,143, now U.S. Pat. No. 9,879,546, filed Jun. 21, 2012 for "AIRFOIL COOLING CIRCUITS" by E. Hudson, T. Propheter-Hinckley, S. Quach and M. Devore, which in turn claims the benefit of PCT International Application No. PCT/US2013/07302 filed Apr. 19, 2013 for "AIRFOIL COOLING CIRCUITS" by E. Hudson, T. Propheter-Hinckley, S. Quach and M. Devore.

STATEMENT OF GOVERNMENT INTEREST

This invention was made with government support under Contract No. N00019-12-D-0002 awarded by the United States Navy. The government has certain rights in the invention.

BACKGROUND

Turbine engine components, such as turbine blades and vanes, are operated in high temperature environments. To avoid structural defects in the components resulting from their exposure to high temperatures, it is necessary to provide cooling circuits within the components. Turbine blades and vanes are subjected to high thermal loads on both the suction and pressure sides of their airfoil portions and at both the leading and trailing edges. The regions of the airfoils having the highest thermal load can differ depending on engine design.

In addition to thermal load problems, cooling film exit holes on such components can frequently become plugged by contaminants. Such plugging can cause a severe reduction in cooling effectiveness as the flow of cooling fluid over the exterior surface of the component is reduced.

Refractory metal core technology offers the potential to provide better cooling for turbine airfoils. Refractory metal core technology allows thin cooling circuits to be placed just under the surface of the airfoil and allows cooling fluid to be expelled into the gaspath. However, state of the art cooling circuits made using refractory metal cores have offered limited configurations in which the cooling fluid is expelled into the gaspath at favorable surface angles to allow effective film cooling.

SUMMARY

An airfoil includes leading and trailing edges; a first side extending from the leading edge to the trailing edge and having an exterior surface, a second side generally opposite the first side and extending from the leading edge to the trailing edge and having an exterior surface; a core passage located between the first and second sides and the leading and trailing edges; and a wall structure located between the core passage and the exterior surface of the first side. The wall structure includes a plurality of cooling fluid inlets communicating with the core passage for receiving cooling fluid from the core passage, a plurality of cooling fluid outlets on the exterior surface of the first side for expelling cooling fluid and forming a cooling film along the exterior surface of the first side, and a plurality of cooling passages communicating with the plurality of cooling fluid inlets and the plurality of cooling fluid outlets. At least a portion of one cooling passage extends between adjacent cooling fluid outlets.

A refractory metal core for use in forming a cooling circuit within the wall of an airfoil includes a first end wall, a second end wall generally opposite the first end wall, first and second sidewalls connecting the first and second end walls, a plurality of first curved tabs bent in a first direction and a plurality of second curved tabs bent in a second direction, wherein adjacent second curved tabs are separated by at least one web.

A method for forming an airfoil includes forming a refractory metal core, forming a ceramic feed core, securing the refractory metal core to the ceramic feed core, investment casting the airfoil around the refractory metal core and the ceramic feed core and removing the refractory metal core and the ceramic feed core from the airfoil to form a cooling circuit in a wall of the airfoil. The cooling circuit has a plurality of cooling fluid inlets communicating with a core passage formed by the ceramic feed core, a plurality of cooling fluid outlets on an external surface of the airfoil and at least one cooling passage portion located between adjacent cooling fluid outlets.

DETAILED DESCRIPTION

Cooling circuits for airfoils can be prepared using refractory metal cores. As described herein, refractory metal cores can be used to create cooling circuits that provide a generally evenly distributed flow of cooling fluid within the walls of the airfoil and a cooling film on exterior surfaces of the airfoil.

Figure 1A:
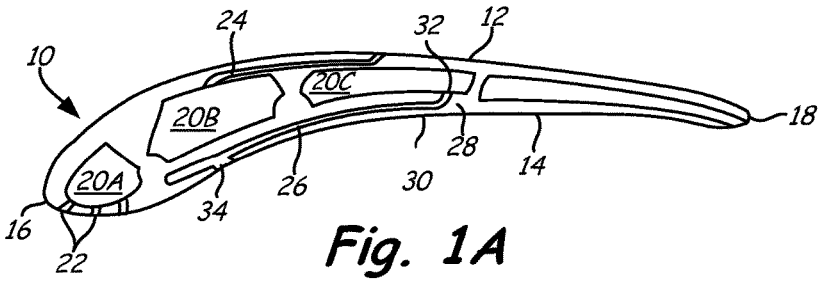
FIG. 1A is a cross section view of an airfoil having a cooling circuit according to one embodiment of the present invention.

FIG. 1A illustrates a cross section view of airfoil portion 10 of a turbine engine component such as a blade or vane. Airfoil portion 10 includes suction side 12, pressure side 14, leading edge 16 and trailing edge 18. Airfoil portion 10 can also include one or more core passages 20 (20A, 20B and 20C in FIG. 1A) through which cooling fluid may flow. Each core passage 20 can communicate with a source (not shown) of a cooling fluid such as engine bleed air.

Airfoil portion 10 can include a number of passageways for cooling various portions of its exterior surface. For example, airfoil portion 10 can have one or more leading edge cooling passageways 22 which are in fluid communication with core passage 20A. Airfoil portion 10 can also include cooling passageway 24 for causing cooling fluid to flow over a portion of suction side 12 or pressure side 14. As shown in FIG. 1A, cooling passageway 24 is located on suction side 12.

Cooling circuits can be provided within the walls of airfoil portion 10 to convectively cool the turbine engine component. As shown in FIG. 1A, cooling circuit 26 can be located in wall 28 between core passage 20 and exterior surface 30 of pressure side 14. Cooling circuit 26 can also be located between core passage 20 and the exterior surface of suction side 12. Cooling circuit 26 includes one or more cooling fluid inlets 32 that communicate with core passage 20. Cooling circuit 26 also includes one or more cooling fluid outlets 34 on exterior surface 30 for causing a cooling fluid film to flow over exterior surface 30 of pressure side 14. Cooling fluid inlets 32 and cooling fluid outlets 34 are connected by a network of cooling passages 36 (shown in FIG. 1C).

Figure 1B:
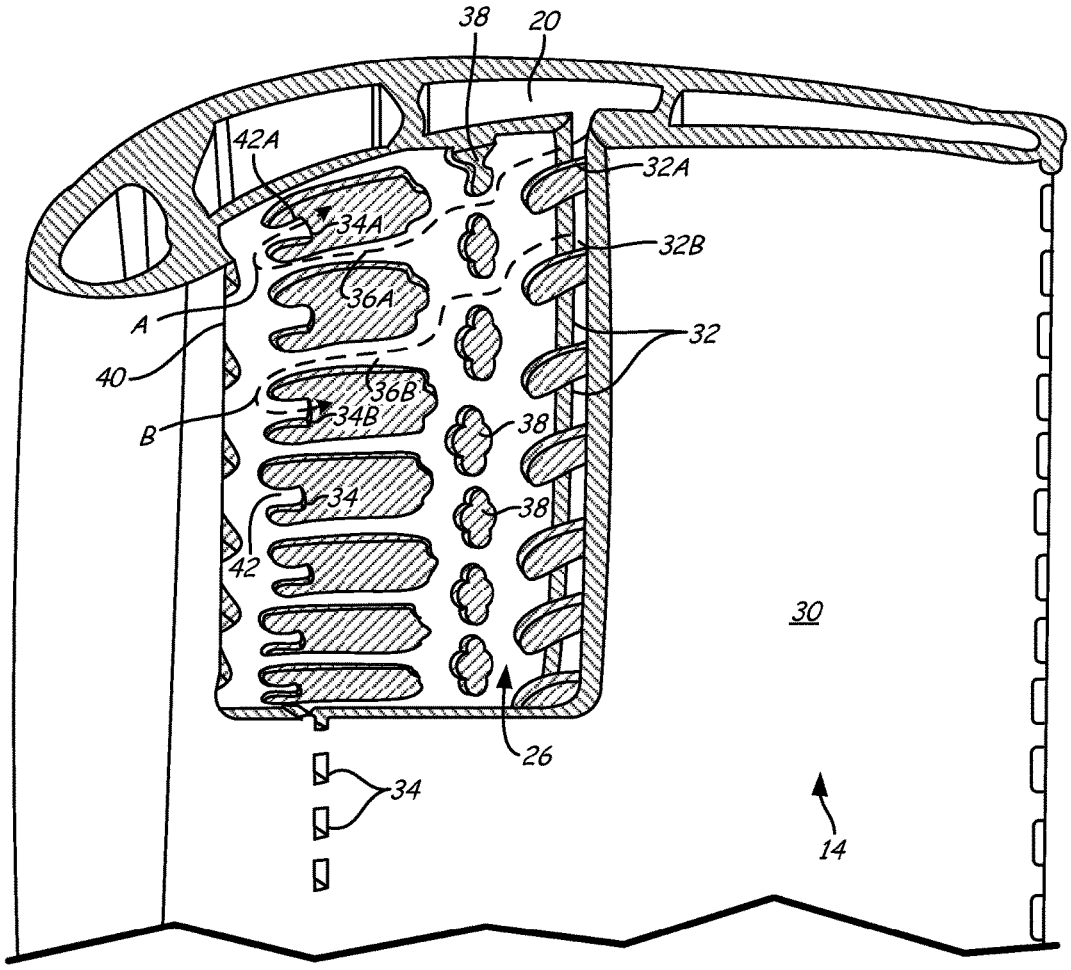
FIG. 1B is a perspective view of the airfoil and cooling circuit of FIG. 1A.

FIG. 1B illustrates a perspective view of the airfoil and cooling circuit of FIG. 1A. A portion of exterior surface 30 of pressure side 14 has been cut away to reveal cooling circuit 26. As shown in FIG. 1B, hatched features are solid elements within cooling circuit 26, while features without hatching represent passageways through which the cooling fluid can flow. Cooling fluid flows from core passage 20 and through cooling fluid inlets 32 and cooling passages 36 to cooling fluid outlets 34. The cooling fluid is directed through cooling circuit 26 by cooling passages 36 and pedestals 38. Pedestals 38 can serve to increase the cooling efficiency of cooling circuit 26. Pedestals 38 can be circular or take more complex shapes as shown in FIG. 1B to shape the path of cooling fluid through cooling circuit 26.

Dashed arrows show some of the potential routes that the cooling fluid can flow through cooling circuit 26. For example, route A (represented by dashed arrow A) travels from cooling fluid inlet 32A to cooling fluid outlet 34A. Cooling fluid enters cooling circuit 26 from core passage 20 at cooling fluid inlet 32A. As shown in FIG. 1B, cooling fluid inlets 32 can be radially aligned in a row along core passage 20. Alternatively, cooling fluid inlets 32 can be arranged in a staggered or radially offset configuration. Cooling fluid inlets 32 can communicate anywhere along the chordwise span of core passage 20 (i.e. anywhere from the leading edge region of core passage 20 to its trailing edge region). The cooling fluid then travels from cooling fluid inlet 32A in a generally upstream direction. The cooling fluid represented by arrow A flows between two pedestals 38 and continues upstream to cooling passage portion 36A. As the cooling fluid approaches upstream end 40 of cooling circuit 26, the flow of fluid is forced to bend and flow in a different direction. The cooling fluid can not flow through upstream end 40 and so it is forced to change its course. The flow of cooling fluid is directed to curved portion 42A of outlet passage 44 (best shown in FIG. 1C) which communicates with cooling fluid outlet 34A. Curved portion 42A bends towards exterior surface 30 of pressure side 14, allowing cooling fluid flowing therethrough to exit cooling circuit 26 through cooling fluid outlet 34A. Route B (represented by dashed arrow B) travels from cooling fluid inlet 32B through cooling passage portion 36B to cooling fluid outlet 34B in a manner similar to route A, albeit through a different combination of inlet, passages and outlets. The network of cooling fluid inlets 32, cooling passages 36, pedestals 38 and cooling fluid outlets 34 allows the cooling fluid to be distributed throughout wall 28. The cooling fluid flowing through the network is able to cool wall 28 and exterior surface 30 of pressure side 14 conductively. As described below in greater detail, cooling air ejected out of cooling fluid outlets 34 also provides film cooling for airfoil portion 10.

Figure 1C:
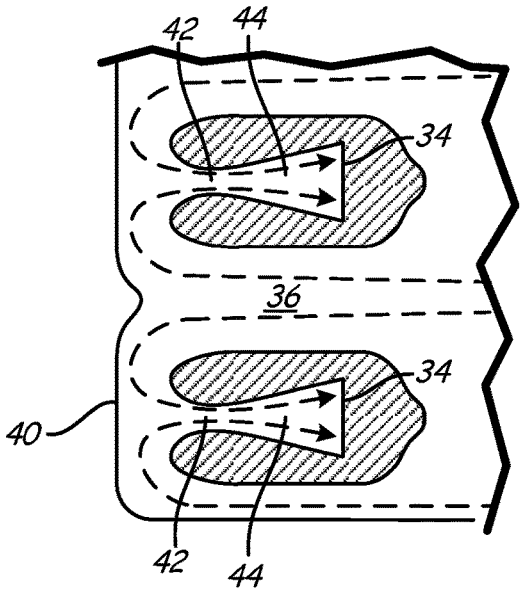
FIG. 1C is a schematic representation of a portion of the cooling circuit of FIG. 1B.
Figure 1D:
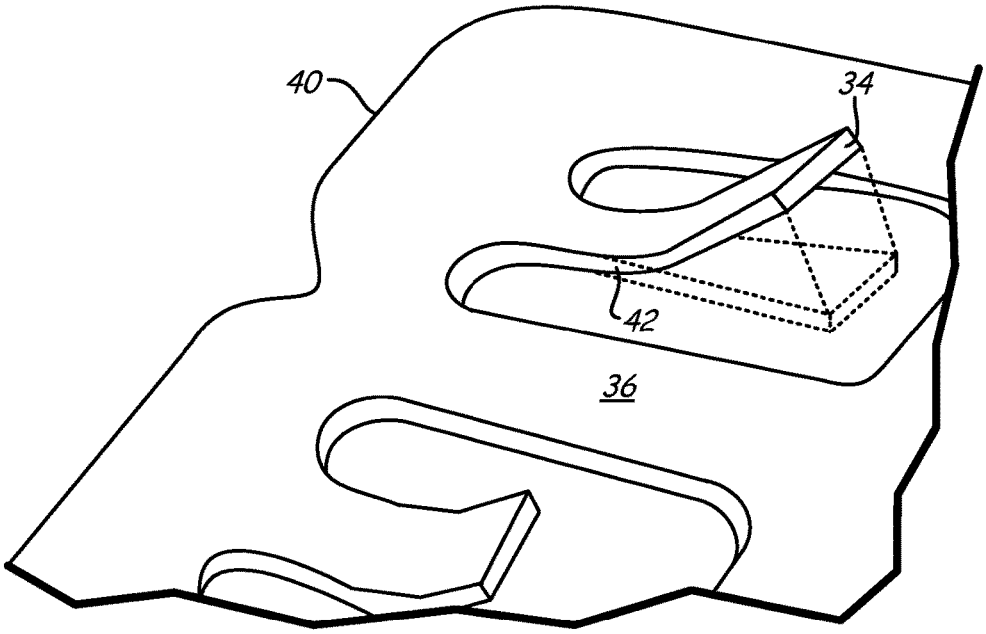
FIG. 1D is a schematic representation of a portion of a core used to form the cooling circuit of FIG. 1B.

FIGS. 1C and 1D illustrate enlarged schematic representations of portions of cooling circuit 26 shown in FIG. 1B. FIG. 1C illustrates two cooling fluid outlets 34, cooling passage 36 and dashed lines representing potential cooling fluid flow paths. Cooling fluid initially travels from right to left through cooling passage 36. Once the cooling fluid nears upstream end 40, the cooling fluid changes direction, eventually reversing direction to travel from left to right, and flows out of cooling fluid outlet 34. As shown in FIG. 1C, outlet passage 44 can be flared so that outlet passage 44 has the largest cross sectional area at cooling fluid outlet 34. FIG. 1D shows a core used to create cooling circuit 26, illustrating curved passage 42. The cores used to form cooling circuits 26 are described in greater detail below.

Once the cooling fluid exits cooling circuit 26 through cooling fluid outlets 34, it forms a cooling film along exterior surface 30 to provide film cooling. As shown in FIG. 1B, exterior surface 30 can include a plurality of cooling fluid outlets 34 radially aligned in a row to form a continuous or near-continuous cooling film along a region of pressure side 14 in a spanwise direction. Alternatively, the plurality of cooling fluid outlets 34 can be arranged in a staggered or radially offset configuration. By forming a cooling film, the cooling fluid cools the portion of exterior surface 30 that it flows over convectively. By flowing the cooling fluid upstream from core passage 20 to cooling fluid outlets 34 located upstream of cooling fluid inlets 32, part of exterior surface 30 is cooled conductively by the flow of the cooling fluid through cooling circuit 26 and convectively by the cooling film formed when the cooling fluid exited cooling fluid outlets 34. This combined cooling feature creates a counter flowing heat exchanger as the cooling fluid cools wall 28 and exterior surface 30 as a result of both its first (upstream) flow and second (downstream) flow.

Figure 2:
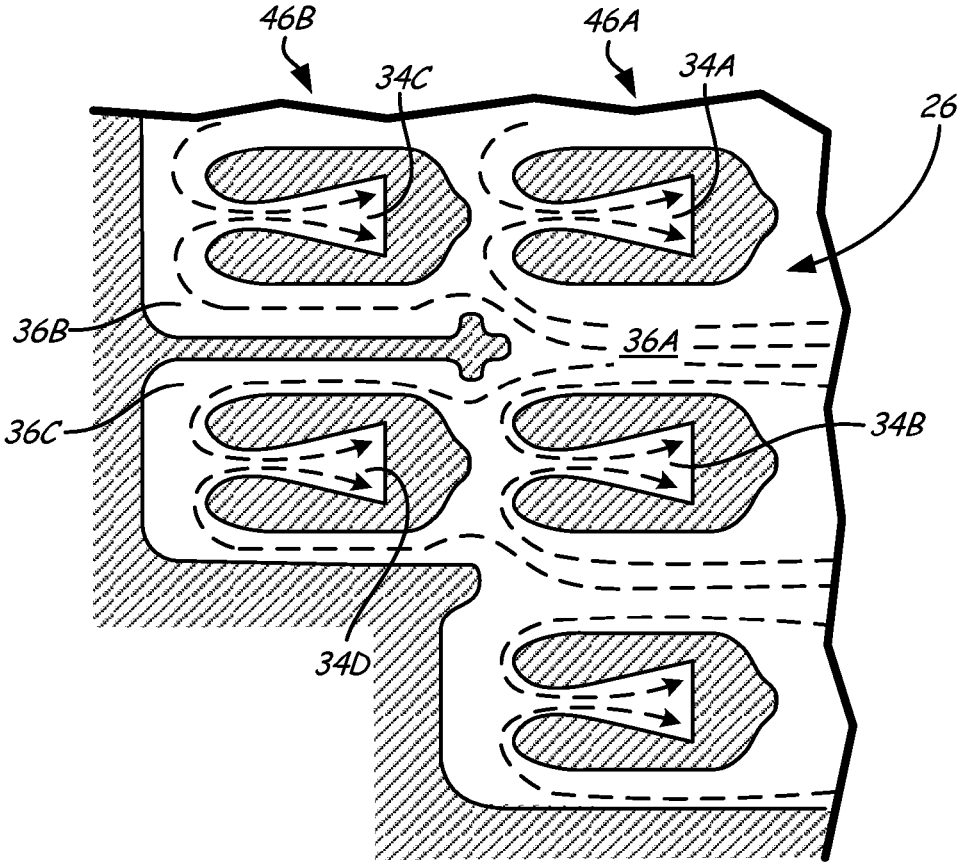
FIG. 2 is a schematic representation of a portion of an alternative embodiment of a cooling circuit.

Cooling circuit 26, cooling fluid inlets 32, cooling fluid outlets 34 and cooling passages 36 can be formed in a variety of configurations. FIG. 2 is a schematic representation of a portion of an alternative embodiment of a cooling circuit illustrated in a way similar to FIG. 1C. Like that of FIG. 1C, FIG. 2 illustrates an embodiment in which the cooling fluid generally flows in an upstream direction from cooling fluid inlet 32 to cooling fluid outlet 34. FIG. 2, however, illustrates two rows 46A and 46B of cooling fluid outlets 34. Row 46A is located downstream of row 46B and each cooling fluid outlet 34 of row 46A is radially aligned with a cooling fluid outlet 34 of row 46B. In this embodiment, cooling passages 36 between adjacent cooling fluid outlets 34 are arranged differently in row 46A than in row 46B. For example, cooling passage portion 36A is located between adjacent cooling fluid outlets 34A and 34B in row 46A. In row 46B, two cooling passage portions (36B and 36C) are located between adjacent cooling fluid outlets 34C and 34D. By locating one or more cooling passage portions 36 between adjacent cooling fluid outlets 34, the flow of cooling fluid within cooling circuit 26 is distributed generally evenly to both provide effective conductive cooling throughout wall 28 and create an effective cooling film at cooling fluid outlets 34 to cool exterior surface 30.

Figure 3:
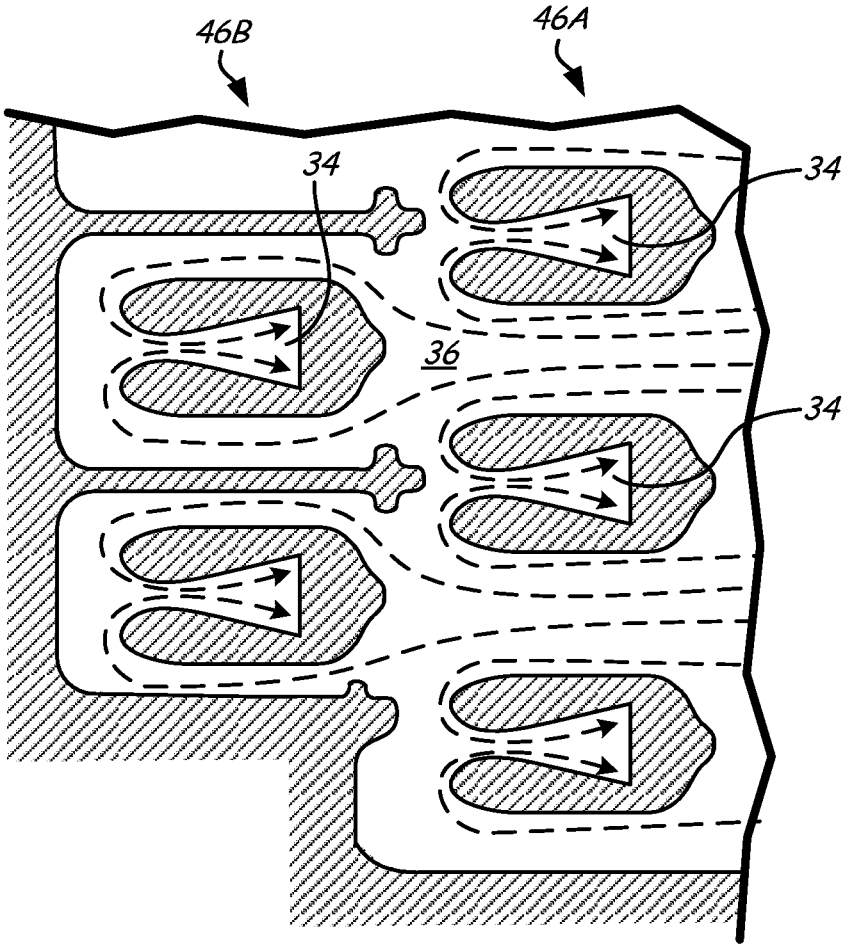
FIG. 3 is a schematic representation of a portion of another alternative embodiment of a cooling circuit.

FIG. 3 is a schematic representation of a portion of another embodiment of a cooling circuit. FIG. 3 is similar to the embodiment illustrated in FIG. 2. Here, however, each cooling fluid outlet 34 of row 46A is not radially aligned with a cooling fluid outlet 34 of row 46B, forming a staggered arrangement of cooling fluid outlets 34 on exterior surface 30. Additionally, while FIG. 1B illustrates cooling circuit 26 on pressure side 14 of airfoil portion 10, cooling circuits 26 can also be located in walls on suction side 12 or on walls of both pressure side 14 and suction side 12 of the same airfoil portion 10.

Figure 4A:
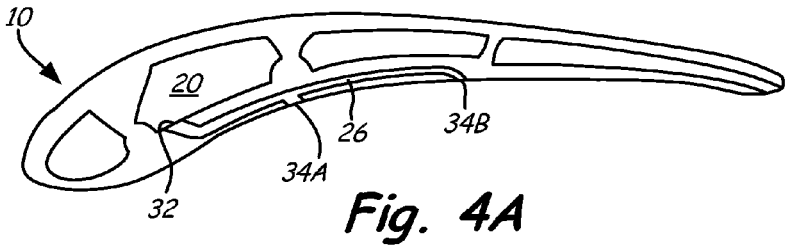
FIG. 4A is a cross section view of an airfoil having an alternative embodiment of a cooling circuit.
Figure 4B:
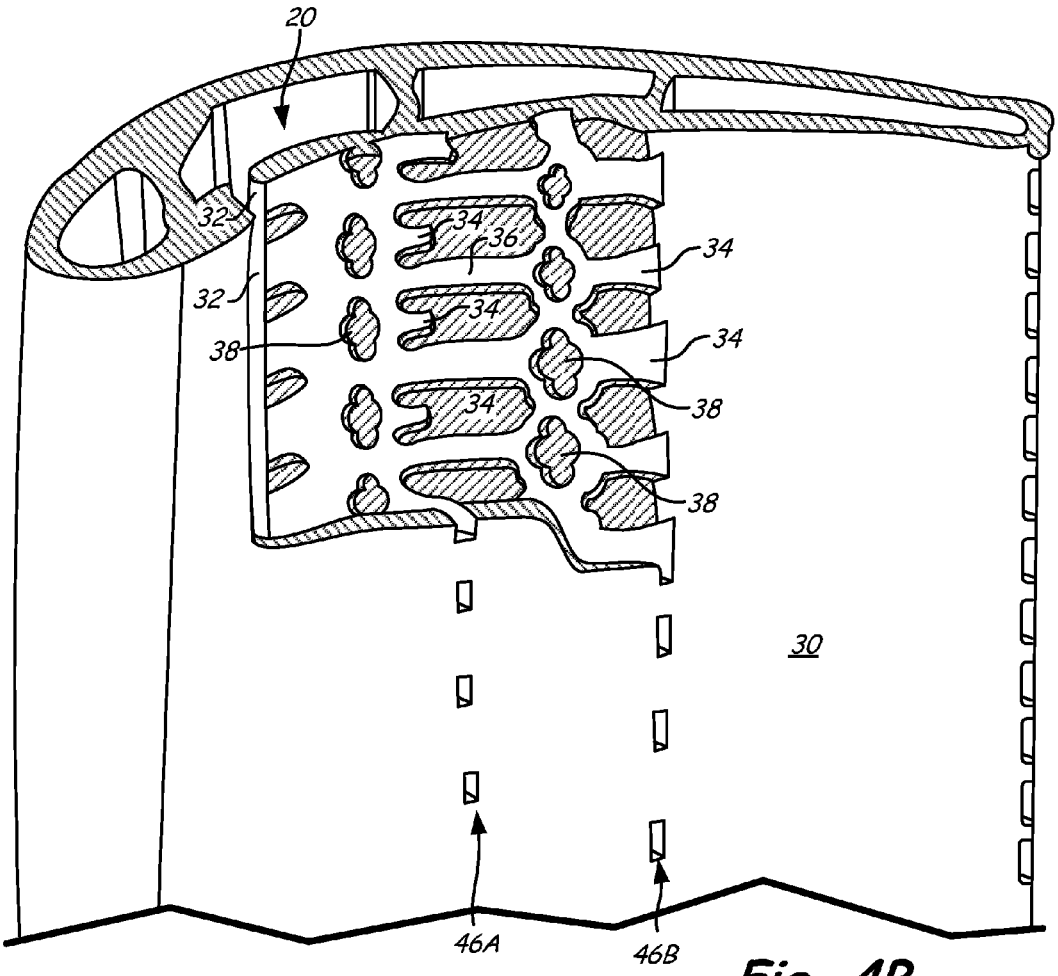
FIG. 4B is a perspective view of the airfoil and cooling circuit of FIG. 4A.
Figure 4C:
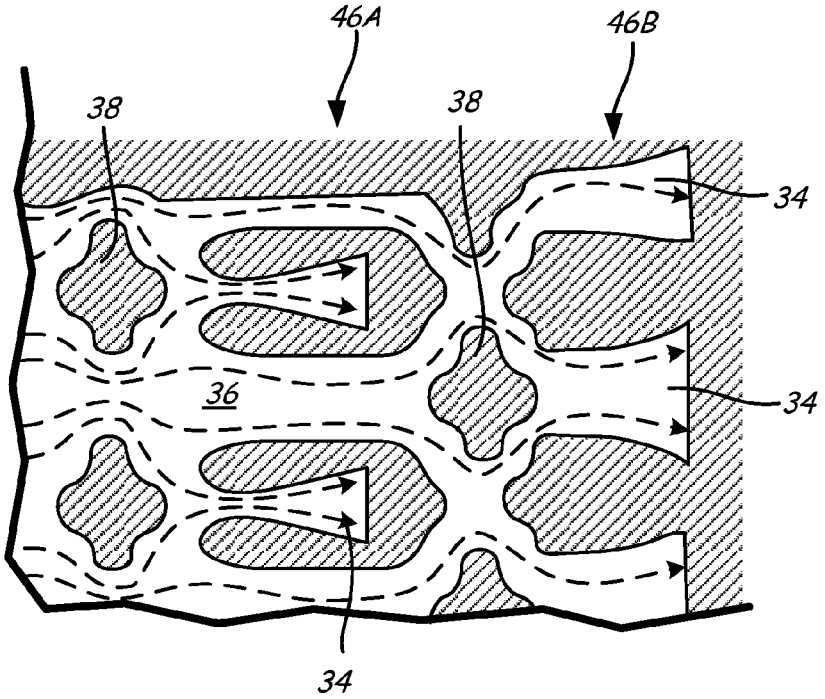
FIG. 4C is a schematic representation of a portion of the cooling circuit of FIG. 4B.

Still another embodiment of cooling circuit 26 is illustrated in FIGS. 4A, 4B and 4C. FIG. 4A illustrates a cross section view of airfoil portion 10, while FIG. 4B illustrates a perspective view of the airfoil and cooling circuit of FIG. 4A, with a portion of exterior surface 30 of pressure side 14 cut away to reveal cooling circuit 26. In this embodiment, cooling fluid inlets 32 are located upstream of cooling fluid outlets 34 and two spanwise rows (46A and 46B) of cooling fluid outlets 34 are present on exterior surface 30. Adjacent cooling outlets 34 in row 46A are separated by cooling passage portions 36, while cooling outlets 34 in row 46B are not. As cooling fluid flows through cooling circuit 26, some of the cooling fluid exits through cooling fluid outlets 34 in row 46A. Cooling fluid that does not exit in row 46A proceeds farther downstream to exit through cooling fluid outlets 34 in row 46B. The region of wall 28 and exterior surface 30 between rows 46A and 46B experience both internal convective (cooling circuit flow) and convective (film) cooling. FIG. 4C is an enlarged schematic representation of portions of cooling circuit 26 shown in FIG. 4B.

Figure 5:
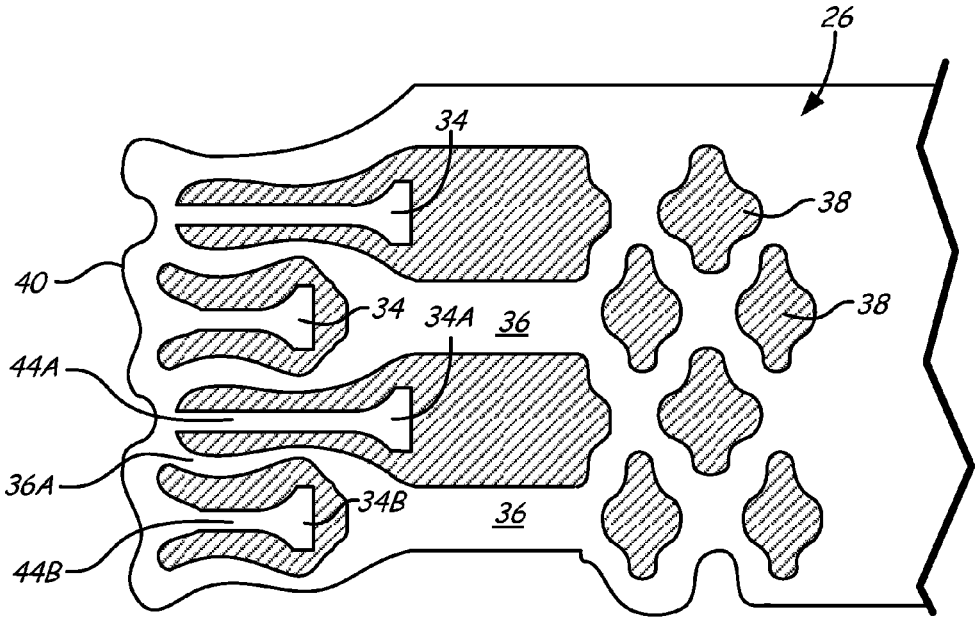
FIG. 5 is a schematic representation of a portion of another embodiment of a cooling circuit.

FIG. 5 is a schematic representation illustrating a portion of another embodiment of cooling circuit 26. In this embodiment, a number of outlet passages 44 are located near upstream end 40 of cooling circuit 26 and the cooling outlets 34 communicating with outlet passages 44 form a staggered configuration. For example, passage 44A communicates with cooling outlet 34A and passage 44B communicates with cooling outlet 34B. Cooling outlets 34A and 34B are adjacent cooling outlets but arranged in a staggered formation (i.e. cooling outlet 34A is located farther downstream airfoil portion 10 than cooling outlet 34B). Although cooling outlet 34A is located farther downstream, the entrance to passage 44A is near the entrance to passage 44B and close to upstream end 40. Cooling passage portion 36A extends between cooling outlet 34A and cooling outlet 34B. Cooling circuit 26 also includes staggered rows of pedestals 38. This configuration provides for internal convective cooling throughout the entirety of cooling circuit 26 and the formation of a staggered cooling film on the exterior surface of the airfoil.

Figure 6:
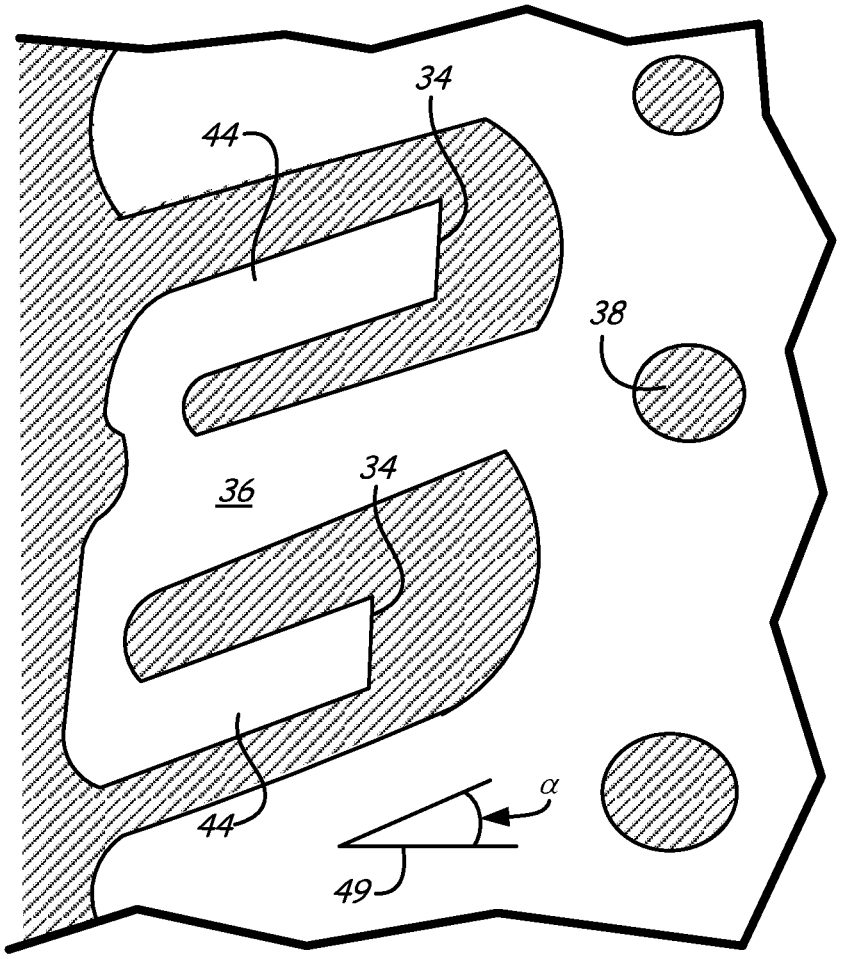
FIG. 6 is a schematic representation of a portion of another embodiment of a cooling circuit.

FIG. 6 is a schematic representation illustrating a portion of another embodiment of a cooling circuit. In this embodiment, outlet passages 44 and cooling outlets 34 are angled radially. Cooling fluid flowing through outlet passage 44 exits cooling outlet 34 at an angle relative to a horizontal axis of the airfoil. Angle $\alpha$ represents the angle formed between outlet passages 44 and cooling outlets 34 and axis 49 (an axis parallel to the axis of rotation). In exemplary embodiments, angle $\alpha$ is between about 0° and about 70°. While FIG. 6 illustrates outlet passages 44 and cooling outlets 34 angled upwards (and away from the axis of rotation), outlet passages 44 and cooling outlets 34 can also be angled downwards (towards the axis of rotation). This configuration provides for conductive cooling within cooling circuit 26 and the formation of a radially angled cooling film on the exterior surface of the airfoil.

Figure 7:
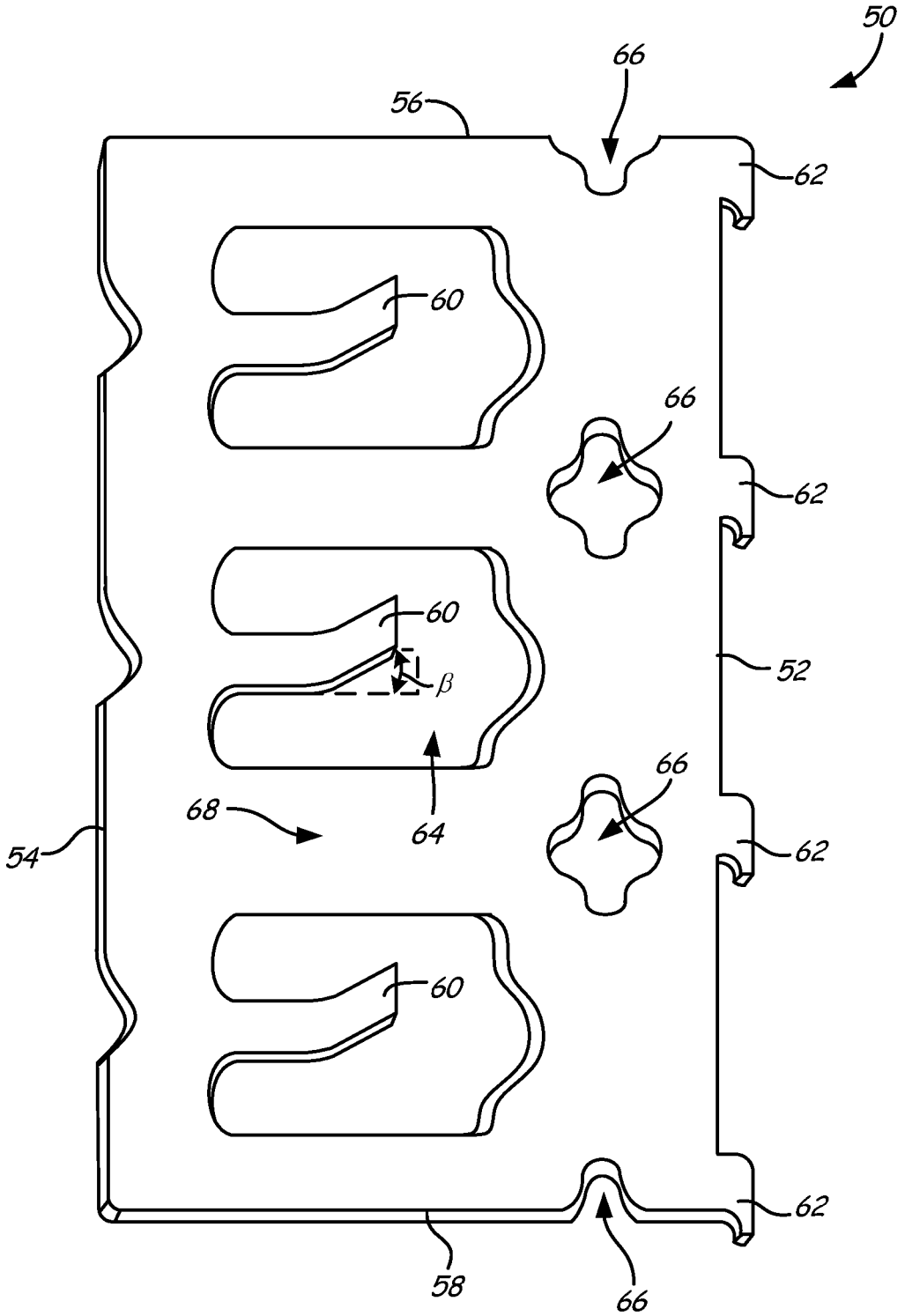
FIG. 7 is a view of a simplified refractory metal core that can be used to form a cooling circuit.

A refractory metal core can be used to form the elements of cooling circuit 26 within wall 28. FIG. 7 is a simplified view of a refractory metal core that can be used to form cooling circuit 26 similar to that shown in FIG. 1B. Refractory metal core (RMC) 50 can be formed from any suitable refractory material. In exemplary embodiments, RMC 50 is formed from a material selected from the group consisting of molybdenum and molybdenum-based alloys. A "molybdenum based alloy" refers to an alloy containing more than 50% molybdenum by weight. Another example of a suitable refractory material is tungsten. Refractory metal core 50 is shaped to conform with the profile of cooling circuit 26 and airfoil portion 10. During the casting process of airfoil portion 10, RMC 50 is placed within a die (not shown). Molten metal is added to the die to form the shape of airfoil portion 10. Once casting is complete, RMC 50 is removed from the component, leaving behind the formed cooling circuit.

Refractory metal core 50 shown in FIG. 7 is a view of a simplified core capable of forming a cooling circuit having four cooling fluid inlets 32, three cooling fluid outlets 34 and four pedestals 38. For cooling circuits 26 having more than this number of features, RMC 50 will include additional elements that form the corresponding features in cooling circuit 26.

Refractory metal core 50 includes first end wall 52 and second end wall 54. A pair of sidewalls 56 and 58 connect end walls 52 and 54. Refractory metal core 50 also includes one or more outwardly angled, bent or curved tabs 60 extending in a first direction which eventually form cooling fluid outlets 34 and one or more inwardly directed, bent or curved tabs 62 which extend in a second direction and form cooling fluid inlets 32. As shown in FIG. 5, tabs 60 are centrally located and spaced from side walls 56 and 58 and end walls 52 and 54. In exemplary embodiments, tabs 60 are substantially linear in configuration and form a shallow angle $\beta$ with the plane of RMC 50. In some embodiments, the plane of RMC 50 is generally parallel to exterior surface 30 of airfoil portion 10. A shallow angle $\beta$ ensures that cooling fluid exiting the formed cooling fluid outlet 34 will form an effective cooling film on exterior surface 30. In exemplary embodiments, angle $\beta$ is between 5° and 45° to expel cooling fluid at an angle between about 5° and about 45° relative to exterior surface 30. In some embodiments, $\beta$ is between 10° and 20° to expel cooling fluid at an angle between about 10° and about 20° relative to exterior surface 30. Tabs 62 are located on first end wall 52. The number of rows and locations of tabs 60 and 62 correspond to the rows and locations of cooling fluid outlets 34 and cooling fluid inlets 32, respectively. For example, in the RMC for forming cooling circuit 26 shown in FIG. 4B, one row of tabs 60 would be located on first end wall 52, another row of tabs 60 would be located between first end wall 52 and second end wall 54, and a row of tabs 62 would be located on second end wall 54.

First end wall 52 forms the downstream end of cooling circuit 26, while second end wall 54 forms upstream end 40 of cooling circuit 26. Refractory metal core 50 also includes openings 64 and 66 extending through RMC 50. Openings 64 and 66 ultimately form the internal solid features within cooling circuit 26. Openings 64 form the structures in between cooling passages 36 that surround cooling fluid outlets 34. Openings 66 form pedestals 38 within cooling circuit 26. Openings 64 and 66 can be arranged in one or more rows. Refractory metal core 50 also includes one or more webs 68. Web 68 is a portion of RMC 50 that extends between adjacent openings 64. Web 68 ultimately forms the portions of cooling passage 36 that separate adjacent cooling fluid outlets 34. Depending on the configuration of RMC 50, zero, one or more webs 68 can be present between adjacent openings 64. For example, one web 68 would be present between adjacent openings 64 to form one cooling passage portion 36 between adjacent cooling fluid outlets 34 in the embodiment of cooling circuit 26 shown in FIG. 1B. On the other hand, two webs 68 would be present between adjacent openings 64 to form cooling passage portions 36B and 36C between cooling fluid outlets 34C and 34D as shown in FIG. 2. No webs 68 would be present between adjacent openings 64 to form row 46B of cooling fluid outlets 34 as shown in FIG. 4B.

Figure 8:
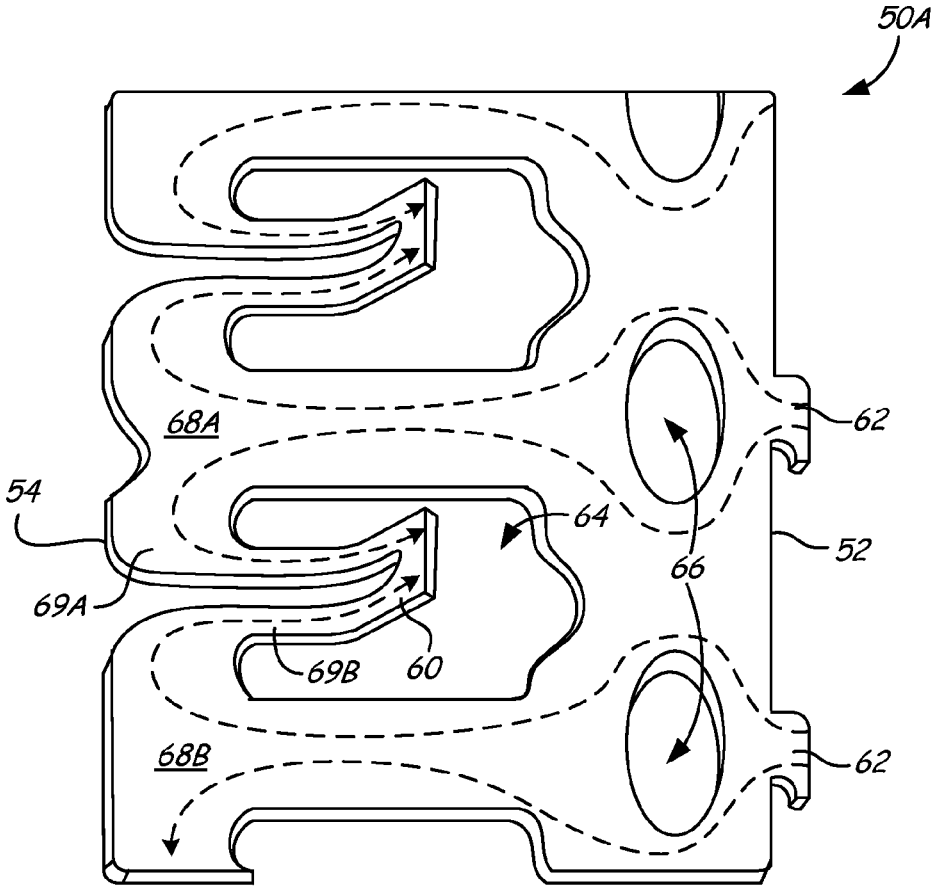
FIG. 8 is a view of another simplified refractory metal core that can be used to form a cooling circuit.

FIG. 8 is a simplified view of another refractory metal core that can be used to form a cooling circuit. Tabs 60 of RMC 50A differs from those of RMC 50 shown in FIG. 7. In addition to webs 68 (primary webs), RMC 50A includes secondary webs 69A and 69B that extend from webs 68. As shown in FIG. 8, secondary web 69A extends downward and then downstream from web 68A and secondary web 69B extends downward and then downstream from web 68B. Second tab 60 is formed where secondary webs 69A and 69B join. In some embodiments, RMC 50A is positioned so that exterior surface 30 of the formed airfoil portion 10 is formed at a depth so that secondary web 69A and secondary web 69B form cooling fluid outlets 34 at exterior surface 30. That is, exterior surface 30 and cooling fluid outlets 34 are formed at a depth below where secondary webs 69A and 69B meet and join to form tab 60 (i.e. tab 60 is located outside formed exterior surface 30 during casting).

Figure 9:
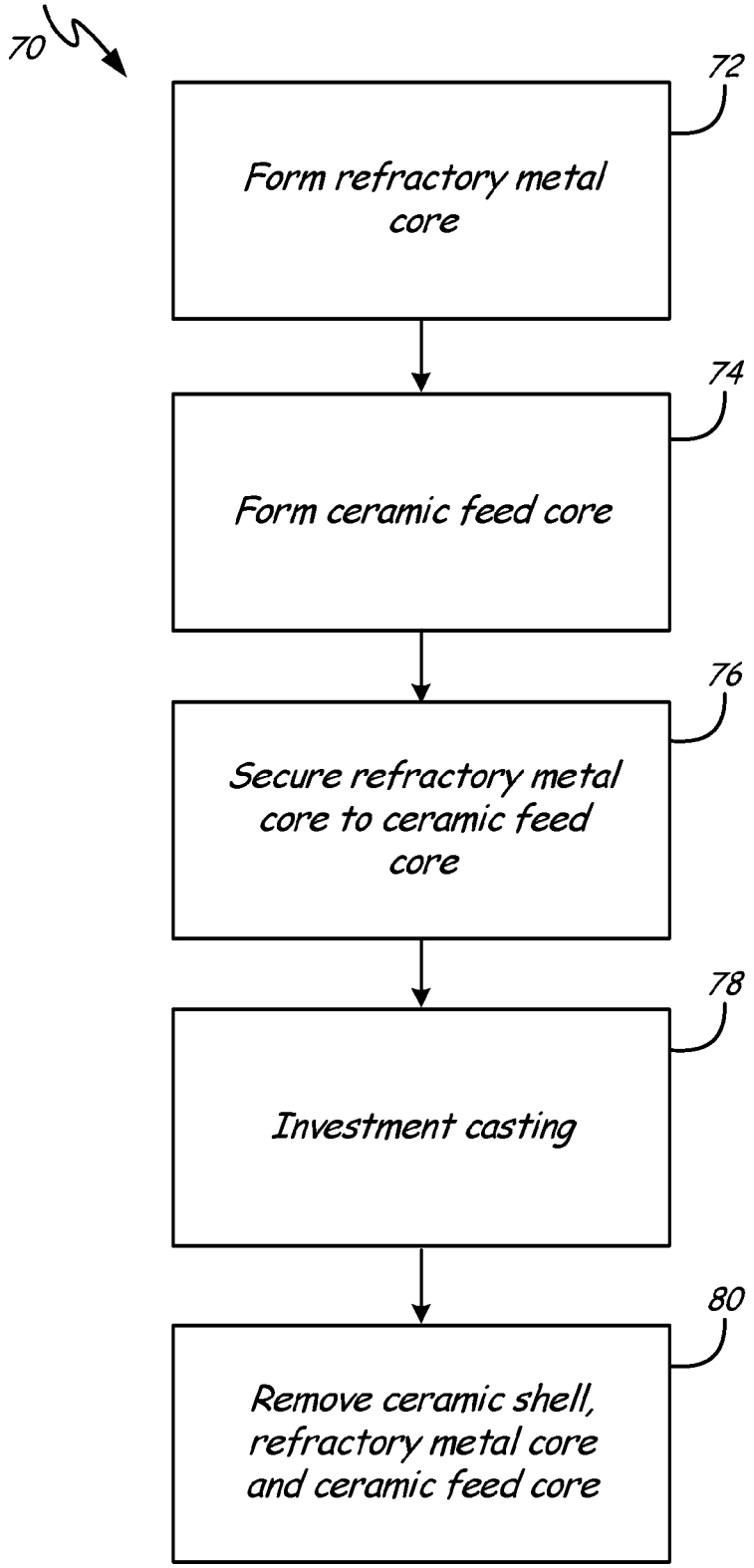
FIG. 9 is a simplified flow diagram of a method for forming an airfoil.

Refractory metal cores 50 can be used to form cooling circuits 26 in airfoils using die or investment casting techniques. FIG. 9 illustrates a simplified flow diagram of one embodiment of an investment casting method (method 70) for forming an airfoil. A refractory metal core (RMC 50) is formed in step 72. A ceramic feed core is formed in step 74. The refractory metal core is secured to the ceramic feed core in step 76. The refractory metal core is secured so that the ends of tabs 62 (as described above) abut a portion of the ceramic feed core. Investment casting processes are then applied in step 78 to form an airfoil. A wax pattern is formed over the refractory metal core and the ceramic feed core. A ceramic shell is then formed over the wax pattern and the wax pattern is removed from the shell. Molten metal is introduced into the ceramic shell. The molten metal, upon cooling, solidifies and forms the walls of airfoil portion 10, the ceramic feed core forms core passages 20 and the refractory metal core forms the profile of cooling circuit 26. The ceramic shell is removed from the cast part. Thereafter, the ceramic feed core and the refractory metal core are removed, typically chemically, using a suitable removal technique (step 80). Removal of the refractory metal core leaves cooling circuit 26 within wall 28 on one side of airfoil portion 10.

Discussion of Possible Embodiments

The following are non-exclusive descriptions of possible embodiments of the present invention.

An airfoil can include leading and trailing edges; a first side extending from the leading edge to the trailing edge and having an exterior surface, a second side generally opposite the first side and extending from the leading edge to the trailing edge and having an exterior surface; a core passage located between the first and second sides and the leading and trailing edges; and a wall structure located between the core passage and the exterior surface of the first side. The wall structure can include a plurality of cooling fluid inlets communicating with the core passage for receiving cooling fluid from the core passage, a plurality of cooling fluid outlets on the exterior surface of the first side for expelling cooling fluid and forming a cooling film along the exterior surface of the first side, and a plurality of cooling passages communicating with the plurality of cooling fluid inlets and the plurality of cooling fluid outlets. At least a portion of one cooling passage can extend between adjacent cooling fluid outlets The airfoil of the preceding paragraph can optionally include, additionally and/or alternatively, any one or more of the following features, configurations and/or additional components:

In a further embodiment of the foregoing airfoil, at least one of the cooling fluid outlets can be positioned to expel cooling fluid at an angle between about 5° and about 45° relative to the exterior surface of the first side of the airfoil.

In a further embodiment of any of the foregoing airfoils, the at least one cooling fluid outlet can be positioned to expel cooling fluid at an angle between about 10° and about 20° relative to the exterior surface of the first side of the airfoil.

In a further embodiment of any of the foregoing airfoils, the cooling fluid inlets can be located closer to the trailing edge than the cooling fluid outlets and the wall structure forms a counter flowing heat exchanger.

In a further embodiment of any of the foregoing airfoils, the plurality of cooling fluid outlets can be arranged in a first spanwise row on the exterior surface of the first side and the wall structure can further include a second plurality of cooling fluid outlets on the exterior surface of the first side for expelling cooling fluid and forming a cooling film along the exterior surface of the first side where the second plurality of cooling fluid outlets can be arranged in a second spanwise row on the exterior surface of the first side.

In a further embodiment of any of the foregoing airfoils, the cooling fluid outlets in the first spanwise row can be radially aligned with the cooling fluid outlets in the second spanwise row.

In a further embodiment of any of the foregoing airfoils, the cooling fluid outlets in the first spanwise row and the cooling fluid outlets in the second spanwise row can be arranged in a staggered formation.

In a further embodiment of any of the foregoing airfoils, at least a portion of two cooling passages can extend between adjacent cooling fluid outlets in the second plurality.

In a further embodiment of any of the foregoing airfoils, the airfoil can further include a second wall structure located between the core passage and the exterior surface of the second side, the second wall structure including a plurality of cooling fluid inlets communicating with the core passage for receiving cooling fluid from the core passage, a plurality of cooling fluid outlets on the exterior surface of the second side for expelling cooling fluid and forming a cooling film along the exterior surface of the second side and a cooling passage communicating with the plurality of cooling fluid inlets and the plurality of cooling fluid outlets where at least a portion of the cooling passage can extend between adjacent cooling fluid outlets.

In a further embodiment of any of the foregoing airfoils, the cooling fluid outlets can be oriented to expel cooling fluid at a non-zero angle relative to an axis of rotation.

A refractory metal core for use in forming a cooling circuit within the wall of an airfoil includes a first end wall, a second end wall generally opposite the first end wall, first and second sidewalls connecting the first and second end walls, a plurality of first curved tabs bent in a first direction and a plurality of second curved tabs bent in a second direction, wherein adjacent second curved tabs are separated by at least one web.

The refractory metal core of the preceding paragraph can optionally include, additionally and/or alternatively, any one or more of the following features, configurations and/or additional components:

In a further embodiment of the foregoing refractory metal core, the refractory metal core can further include a plurality of openings positioned between the first and second end walls and the first and second sidewalls.

In a further embodiment of any of the foregoing refractory metal cores, the refractory metal core can further include a first secondary web extending from the at least one web and a second secondary web extending from a second at least one web where the first and second secondary webs are arranged so that each forms a separate cooling fluid outlet on an exterior surface of an airfoil.

In a further embodiment of any of the foregoing refractory metal cores, the plurality of first curved tabs can be located on the first end wall and the plurality of second curved tabs are located between the first and second end walls.

In a further embodiment of any of the foregoing refractory metal cores, the refractory metal core can further include a plurality of third curved tabs bent in the second direction.

In a further embodiment of any of the foregoing refractory metal cores, adjacent third curved tabs can be separated by at least one web.

In a further embodiment of any of the foregoing refractory metal cores, adjacent third curved tabs can be separated by two webs.

In a further embodiment of any of the foregoing refractory metal cores, the plurality of first curved tabs can be located on the second end wall, the plurality of second curved tabs can be located between the first and second end walls and the plurality of third curved tabs can be located on the first end wall.

In a further embodiment of any of the foregoing refractory metal cores, at least one second curved tab can include a flared end.

A method for forming an airfoil can include forming a refractory metal core, forming a ceramic feed core, securing the refractory metal core to the ceramic feed core, investment casting the airfoil around the refractory metal core and the ceramic feed core and removing the refractory metal core and the ceramic feed core from the airfoil to form a cooling circuit in a wall of the airfoil. The cooling circuit can have a plurality of cooling fluid inlets communicating with a core passage formed by the ceramic feed core, a plurality of cooling fluid outlets on an external surface of the airfoil and at least one cooling passage portion located between adjacent cooling fluid outlets.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A refractory metal core comprising:

a refractory metal sheet comprising:

a downstream end wall;

an upstream end wall opposite the downstream end wall;

a first sidewall connecting the downstream end wall to the upstream end wall;

a second sidewall connecting the downstream end wall to the upstream end wall, the second sidewall opposite the first sidewall;

a plurality of primary curved tabs located between the downstream end wall and the upstream end wall and aligned between the first sidewall and the second sidewall, the plurality of primary curved tabs extending outwardly from the refractory metal sheet in a first direction;

a plurality of primary openings in the refractory metal sheet, wherein each one of the plurality of primary openings is proximate to one of the plurality of primary curved tabs;

a plurality of secondary curved tabs proximate the downstream endwall, the plurality of secondary curved tabs extending outwardly from the refractory metal sheet;

a plurality of secondary openings in the refractory metal sheet located between the plurality of primary curved tabs and the plurality of secondary curved tabs;

a plurality of primary webs extending between two of each of the plurality of primary openings in the refractory metal sheet; and a plurality of secondary webs extending from and reversing direction of the plurality of primary webs, two of each of the plurality of secondary webs converging at one of the plurality of primary curved tabs.

2. The refractory metal core of claim 1, wherein each of the plurality of primary webs extends into two of the plurality of secondary webs.

3. The refractory metal core of claim 2, wherein each of the plurality of primary webs define a gas flowpath in a first direction.

4. The refractory metal core of claim 3, wherein each of the plurality of secondary webs define a gas flowpath in a second direction opposite the first direction.

* * * * *